US008796934B2

(12) United States Patent
Kuehn et al.

(10) Patent No.: US 8,796,934 B2
(45) Date of Patent: Aug. 5, 2014

(54) MINIATURIZABLE PLASMA SOURCE

(75) Inventors: Silvio Kuehn, Wandlitz (DE); Roland Gesche, Seligenstadt (DE); Horia-Eugen Porteanu, Berlin (DE)

(73) Assignee: Forschungsverbund Berlin E.V., Berlin (DE)

( * ) Notice: Subject to any disclaimer, the term of this patent is extended or adjusted under 35 U.S.C. 154(b) by 8 days.

(21) Appl. No.: 13/575,981

(22) PCT Filed: Jan. 28, 2011

(86) PCT No.: PCT/EP2011/051234

§ 371 (c)(1),
(2), (4) Date: Aug. 27, 2012

(87) PCT Pub. No.: WO2011/092298

PCT Pub. Date: Aug. 4, 2011

(65) Prior Publication Data

US 2012/0313524 A1 Dec. 13, 2012

(30) Foreign Application Priority Data

Jan. 29, 2010 (DE) ..... 10 2010 001 395

(51) Int. Cl.
*H01J 7/24* (2006.01)

(52) U.S. Cl.
USPC ..... 315/111.21; 315/111.51; 315/111.81; 315/248; 315/267

(58) Field of Classification Search
USPC ..... 315/111.21–111.81
See application file for complete search history.

(56) References Cited

U.S. PATENT DOCUMENTS

| | | | | |
|---|---|---|---|---|
| 3,495,125 | A * | 2/1970 | Koontz | 333/35 |
| 3,663,858 | A | 5/1972 | Lisitano | |
| 4,797,597 | A * | 1/1989 | Bostrom | 315/39 |
| 4,918,031 | A | 4/1990 | Flamm et al. | |
| 6,304,036 | B1 | 10/2001 | Freeman et al. | |
| 6,329,757 | B1 * | 12/2001 | Morrisroe et al. | 315/111.51 |

(Continued)

FOREIGN PATENT DOCUMENTS

| | | |
|---|---|---|
| DE | 4337119 | 5/1995 |
| WO | WO 2011/092298 | 8/2011 |

*Primary Examiner* — Douglas W Owens
*Assistant Examiner* — Srinivas Sathiraju

(57) ABSTRACT

The invention relates to a plasma source with an oscillator having an active element and a resonator connected to the active element. The resonator has a hollow body, a gas inlet, a gas outlet arranged at a distal end of the hollow body about a longitudinal axis of the hollow body, and a coil arranged along the longitudinal axis of the hollow body, said coil having an effective length of one quarter of a wavelength at a resonant frequency of the resonator. A distal end of the coil is arranged relative to the gas outlet such that a plasma section can form between the distal end of the coil serving as a first plasma electrode and the gas outlet of the hollow body serving as a second plasma electrode. At a proximal end of the hollow body, the coil is lead out of the interior of the hollow body through an electrically contact-free feed-through, and a proximal end of the coil contacts the hollow body at its external side. At a first contact region located between the proximal end of the coil and the feed-through, the coil is coupled to a first gate of the active element, and at a second contact region located between the proximal end of the coil and the feed-through, the coil is coupled to a second gate of the active element.

13 Claims, 4 Drawing Sheets

(56) References Cited

U.S. PATENT DOCUMENTS

Figure 1:
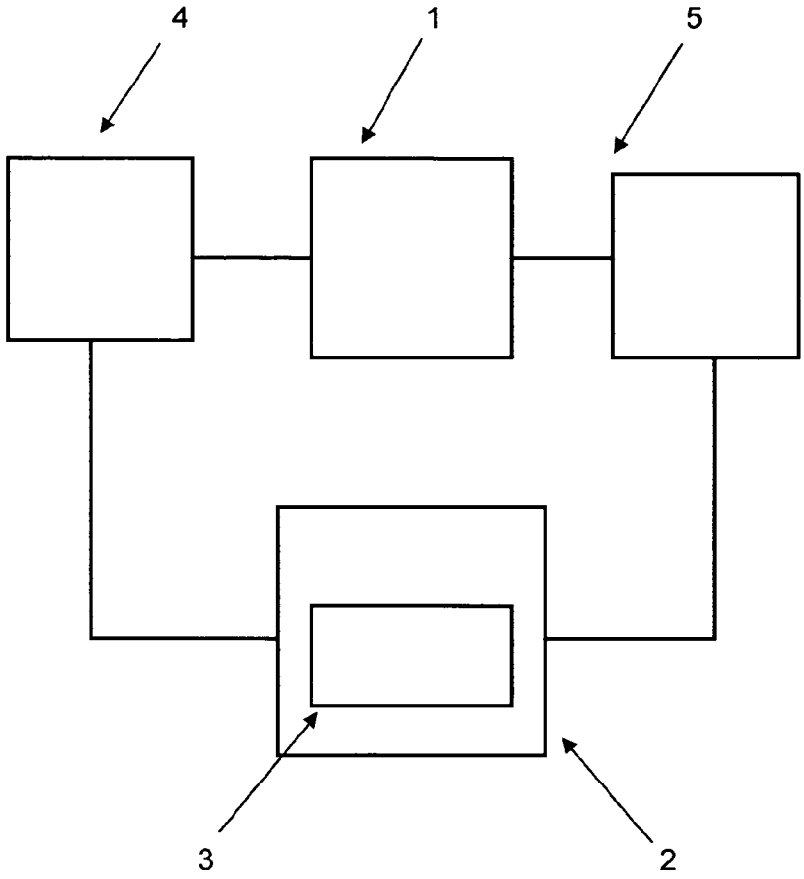

| | | | | |
|---|---|---|---|---|
| 6,649,076 | B2 | 11/2003 | Tamitani | |
| 7,459,899 | B2 * | 12/2008 | Mattaboni et al. | 324/76.53 |
| 7,547,911 | B2 * | 6/2009 | Higashiwaki | 257/20 |
| 2002/0125223 | A1 * | 9/2002 | Johnson et al. | 219/121.43 |
| 2006/0266637 | A1 | 11/2006 | Gutsol et al. | |
| 2006/0285108 | A1 | 12/2006 | Morrisroe | |
| 2008/0078745 | A1 | 4/2008 | Cordell et al. | |
| 2009/0260973 | A1 | 10/2009 | Proudkii et al. | |

* cited by examiner

MINIATURIZABLE PLASMA SOURCE

RELATED APPLICATIONS

This application is a National Phase of PCT Patent Application No. PCT/EP2011/051234 having International filing date of Jan. 28, 2011, which claims the benefit of priority of German Patent Application No. DE102010001395.1 filed on Jan. 29, 2010. The contents of the above applications are all incorporated by reference as if fully set forth herein in their entirety.

TECHNICAL FIELD

The invention relates to a miniaturizable plasma source and its utilization.

BACKGROUND OF THE INVENTION

Plasma, that is, at least partially ionized gas, can be used in a wide range of technical applications, for example for surface coating, surface activation, sterilization, etching processes and other similar applications. Common plasma sources, however, are expensive, large, operate at low gas pressures and have a high power consumption. There is therefore a need for a cost-effective miniaturizable plasma source which operates at atmospheric pressure and with low power consumption.

SUMMARY OF THE INVENTION

The invention thus introduces a plasma source with an oscillator having an active element and a resonator connected to the active element. The resonator has a hollow body, a gas inlet, a gas outlet arranged at a distal end of the hollow body about a longitudinal axis of the hollow body, and a coil arranged along the longitudinal axis of the hollow body, said coil having an effective length of one quarter of a wavelength at a resonant frequency of the resonator. A distal end of the coil is arranged relative to the gas outlet such that a plasma section can form between the distal end of the coil serving as a first plasma electrode and the gas outlet of the hollow body serving as a second plasma electrode. In accordance with the invention, the coil is lead out of the interior of the hollow body at a proximal end of the hollow body through an electrically contact-free feed-through, where "electrically contact-free" means that there is no conductive connection between the coil and the hollow body in the region of the feed-through. A proximal end of the coil contacts the hollow body at its external side. At a first contact region located between the proximal end of the coil and the feed-through, the coil is coupled to a first gate of the active element, and at a second contact region located between the proximal end of the coil and the feed-through, the coil is coupled to a second gate of the active element. The first contact region and the second contact region are not the same. The first gate can be an output of the active element, said active element serving as an amplifier, and the second gate can be an input of the active element.

The plasma source of the invention can be miniaturized and thus be designed as a portable device. Since the plasma itself is a part of the oscillator in the electrical equivalent circuit diagram, a very simple design of the plasma source is made possible. After ignition, the plasma acts as load and co-determines the resonance properties of the resonator and the entire oscillating circuit. In resonance without ignited plasma, there is high decoupling from the resonator via the second contact region to the second gate of the active element, so that the arrangement corresponds to the circuit topology of a feedback amplifier and is reliably actuated. The oscillation of the feedback amplifier creates a field strength in the resonator that is required for igniting the plasma. Accordingly, the plasma is ignited once a certain power level is reached, said power level depending on the respective circumstances, like the type of gas and so on.

The plasma source of the invention has the additional advantage that a simple mechanical design of the resonator is made possible. Since the coil is lead out of the hollow body to the outside in an electrically contact-free manner, said coil can be constructed outside the hollow body using simple means, such as micro-strip lines, which can be manufactured cost-effectively. Apart from the coil, the resonator does not need to have any additional elements inside the hollow body.

The first contact region can be coupled to the first gate of the active element through a first capacitor. The first capacitor does not only block a direct current which may be present for adjusting the operating point of the active element but also contributes to the resonance, thus simplifying the actuation of the oscillator. Thus, this preferred embodiment is a coupled multiple-circuit oscillating circuit.

The coil can be inductively coupled to the second gate of the active element at the second contact region. This embodiment has the advantage that the signal feedback to the second gate of the active element is automatically stopped when the plasma ignites because, at that moment, the entire effective power coupled in by the active element into the resonator is used for exciting the plasma and the current in the coil becomes zero or at least near zero in the second contact region, so that the magnetic field required for inductive coupling is no longer produced.

The plasma source can have a feedback line arranged in the second contact region along and spaced apart from the coil and being designed such as to couple the coil inductively to the second gate of the active element. Preferably, the coil is not wound in its section located outside the hollow body, or in other words, it is constructed as a simple conductor in that section, so that the coil and the feedback line can be easily run along each other.

The feedback line preferably contacts the hollow body at its external side.

The feedback line can be coupled to the second gate of the active element through a second capacitor.

Particularly preferably the coil is constructed as a micro-strip line in the section between the feed-through and the proximal end of the coil. The feedback line can be constructed as a micro-strip line as well.

Preferably, the first gate of the active element is connected to a first matching network and the second gate of the active element is connected to a second matching network. This serves to optimize the power transmission between the individual components of the arrangement.

The first matching network can have a first variable capacitor and the second matching network can have a second variable capacitor. This embodiment has the advantage that the matching can be adjusted during operation.

The plasma source can have a first DC power feed connected to the first gate of the active element and a second DC power feed connected to the second gate of the active element. In this way, the operating point of the active element can be set freely, and owing to the first and the second capacitor this has no influence on the resonator, which is to say that the properties of the resonator do not change when the operating point of the active element is changed.

The active element preferably has a GaN transistor or is a GaN transistor. GaN transistors can provide the power required for operating a plasma source even with high oscillation frequencies in the gigahertz range. Here the second gate of the active element can be the gate of the GaN transistor.

The GaN transistor is preferably configured in a common source configuration. The first gate of the active element can thus be the drain of the GaN transistor.

The hollow body of the resonator can have a cylindrical shape. This creates a hollow waveguide structure with particularly good resonance properties around the coil, with the coil being preferably constructed along the axis of the resonator.

The plasma source can have a gas feed connected to the gas inlet, said gas feed being designed such as to pump a plasma gas through the gas inlet into the hollow body of the resonator. By pumping plasma gas into the hollow body of the resonator, a continuous stream of plasma out of the gas outlet of the resonator is effected once the plasma has been ignited, said stream of plasma being usable in a wide range of applications. If, for example, the plasma source is operated with a nitrogen-oxygen mixture such as air, nitrogen oxide and ozone are created in the plasma, and the proportions of nitrogen oxide and ozone can be influenced by adjusting the proportions of nitrogen and oxygen. In this context it is also possible to create only ozone or only nitrogen oxide. Ozone can be advantageously used for the destruction of germs, while nitrogen oxide improves wound healing.

The oscillator of the invention preferably functions as a reflection oscillator once the plasma is ignited. Depending on the state of the plasma (ignited/not ignited) the active element can be operated in different modes of operation, such as Class A, Class AB, Class B or Class C mode.

A second aspect of the present invention relates to the utilization of a plasma source according to the first aspect of the invention for activating, cleaning, sterilizing and coating surfaces, for etching, and for purifying water and exhaust gases.

SHORT DESCRIPTION OF THE FIGURES

Figure 3:
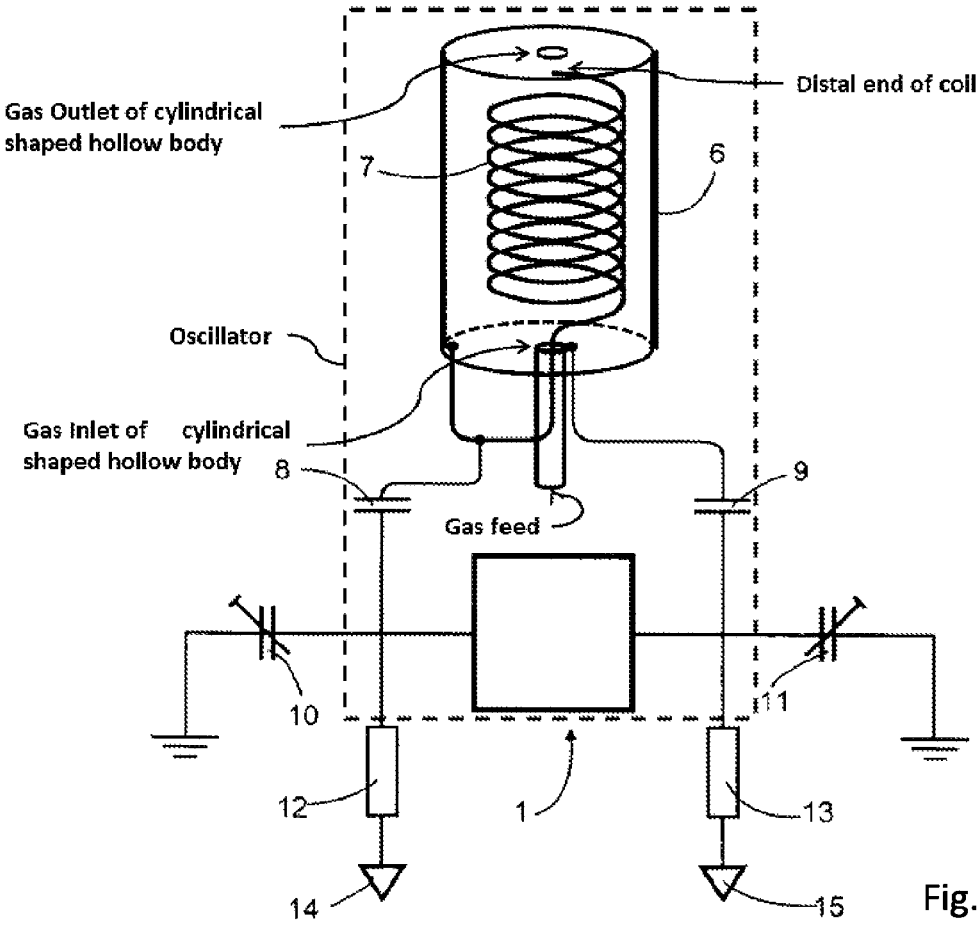
Figure 4:
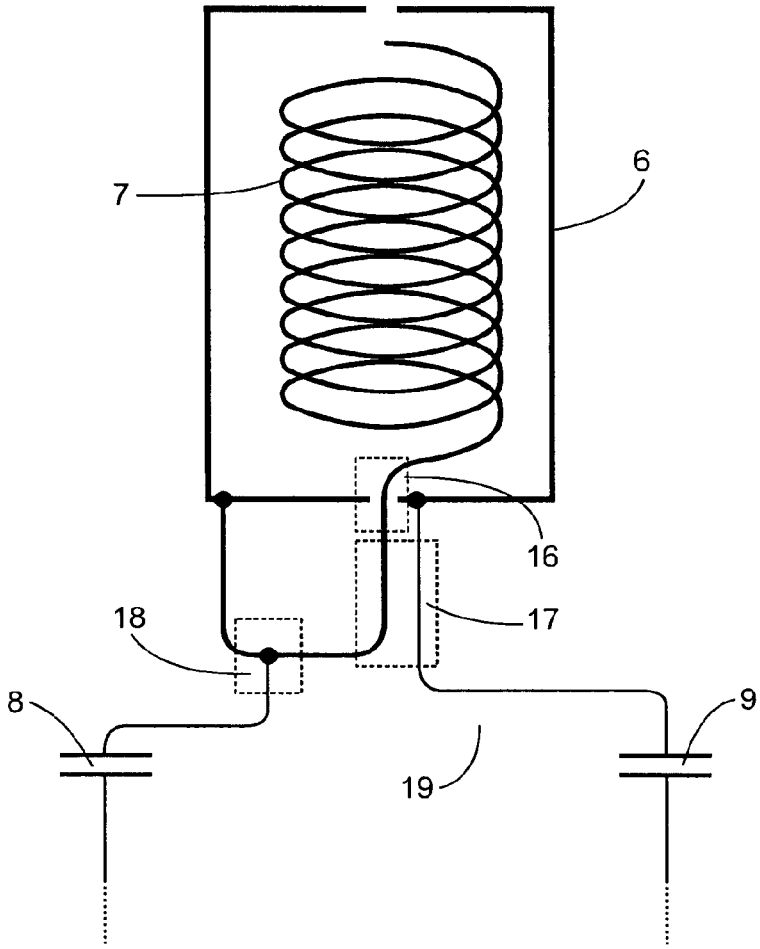

In the following, the invention will be described in greater detail using figures of embodiments, in which:

FIG. 1 shows a block diagram of a plasma source of the invention;

FIG. 2 in its two sub-figures shows different operating states of the plasma source of the invention;

FIG. 3 shows a circuit diagram of a preferred embodiment of the plasma source of the invention; and FIG. 4 shows an enlarged section of the circuit diagram of FIG. 3.

DETAILED DESCRIPTION OF THE FIGURES

FIG. 1 shows a block diagram of a plasma source of the invention. The plasma source of the invention has an oscillator structure. An output of an active element 1, which supplies the electrical amplification required for stable oscillation, is connected via a first matching network 5 to a resonator 2. The resonator 2 has the tasks of generating the required ignition field strength and determining the frequency of the oscillation. The resonator 2 is in turn connected via a second matching network 4 to an input of the active element 1, thereby generating feedback. At the same time, the resonator 2 forms the plasma chamber of the plasma source, and in a preferred embodiment a gas for generating the plasma is passed through the resonator 2, said gas thus being continuously ignited by the oscillation of the oscillator if the E-field is high enough. The ignited plasma 3 influences the electrical properties of the resonator 2 and feeds back on the output and input of the resonator 2, which is why it is displayed as a part of the equivalent circuit diagram of the plasma source.

Figure 2A:
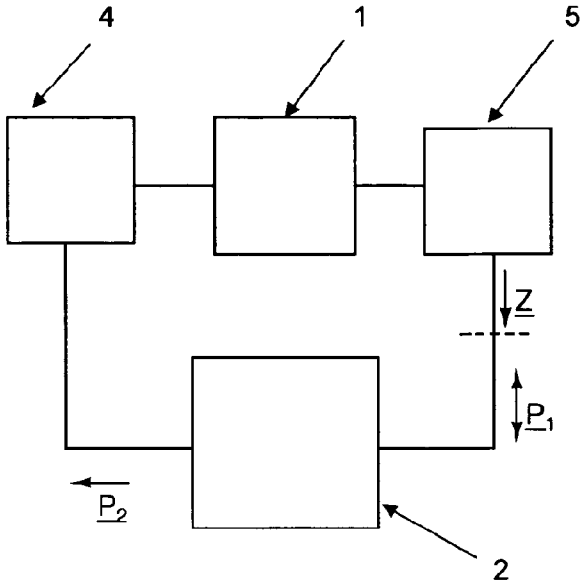
Figure 2B:
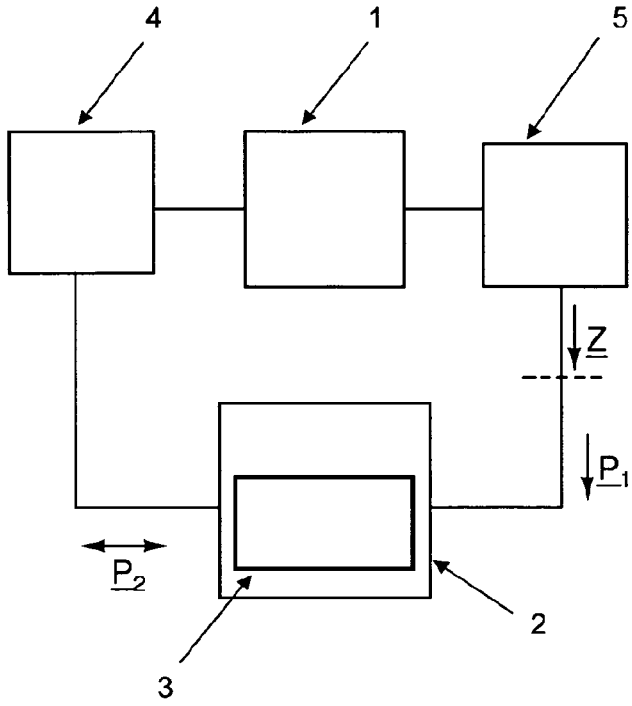

FIG. 2 in its two sub-figures shows different operating states of the plasma source of the invention. FIG. 2A shows the state of the plasma source before igniting the gas and FIG. 2B the state once the gas has been ignited. During idle mode, that is, in the state without ignited gas, the oscillator has the circuit topology of a feedback amplifier with strongly mismatched load. This means that the impedance to the resonator 2 has a large reactive component and that the complex power $P_1$ transmitted between the first matching network 5 and the resonator 2 also has a high reactance, i.e. its imaginary component is large. A large part of the little amount of active power $Re(P_1)$ supplied is transmitted to the well-matched second matching network 4, so that $P_2$ has a comparatively large real component. The difference $Re(P_2)-Re(P_1)$ is converted into heat through the loss of the resonator 2 but also creates the field strength in the resonator 2 that is required for igniting the plasma 3. When the plasma is ignited (FIG. 2B), the impedance Z with its large imaginary component changes into a predominantly real resistance. The transmitted power $P_1$ is now real and thus constitutes an active power. The power $P_2$, however, becomes highly reactive and a distinctive active power transport from the resonator output to the input of the active element 1 is now missing. The oscillator thus works in the operating state with ignited plasma as a kind of reflection oscillator, wherein the reflecting load is the output of the resonator 2 and the input of the active element 1 provides the required negative impedance. The input of the resonator 2, on the other hand, is well matched.

FIG. 3 shows a circuit diagram of a preferred embodiment of the plasma source of the invention. The direct currents at the input and output of the active element 1 can be predetermined by the voltage sources 14 and 15 via decoupling resistors 12 and 13, thus setting the operating point of the active element 1. Preferably, capacitors 10 and 11 of adjustable capacity are arranged on both sides of the active element 1 and connected between input and output, respectively, of the active element 1 and ground, said capacitors functioning as matching networks. In the embodiment shown, input and output of the active element 1 are each connected to the resonator via a coupling capacitor 8 and 9, respectively, the resonator having the shape of a cylindrical hollow body 6 in which there are a gas inlet and a gas outlet for passing the plasma gas through it, said gas inlet and outlet being located on opposing front sides of the hollow body, in the preferred embodiment shown. However, embodiments without the first and/or the second capacitor are possible as well. Along the cylinder axis of the cylindrical hollow body 6, a $\lambda/4$ line wound into a coil 7 is arranged and conductively connected to the cylindrical hollow body 6 at its external side. Both the wound section of the $\lambda/4$ line and the section of the $\lambda/4$ line located outside the hollow body 6 are referred to as coil 7 in this context. The cylindrical hollow body 6 also has a decoupling element which is implemented as a feedback line connected to the coupling capacitor 9 and, at least partially, run along the section of the coil 7 located outside the hollow body 6.

FIG. 4 shows an enlarged section of the circuit diagram of FIG. 3. The resonator with the hollow body 6 and the coil 7 is displayed here. It can be seen more clearly here than in FIG. 3 that the coil 7 is led outside through the hollow body 6 in an electrically contact-free feed-through 16. Here it is, for example, possible to arrange a gas-tight insulator between the coil 7 and the hollow body 6 or to use the feed-through 16 as a gas inlet. Outside the hollow body 6, the coil 7 is preferably constructed as an easy-to-build micro-strip line and contacts the hollow body 6. Such an arrangement can be more robust and cost-effectively manufactured than previously known resonator arrangements. In a first contact region 18 located between the feed-through 16 and the end of the coil 7 which is conductively connected to the hollow body 6, the coil 7 is coupled to the first gate of the active element through a first capacitor. The first contact region 18 is located outside the hollow body 6 and in relative proximity to the end of the coil which, however, constitutes a ground point and therefore can not couple the signal of the active element at the same time. For this reason, the first contact region 18 is spaced apart from the end of the coil connected to the hollow body 6. A second contact region 17 is also located between the feed-through 16 and the end of the coil connected to the hollow body 6. The second contact region is located between the feed-through 16 and the first contact region 18 in the embodiment shown. The second contact region 17 serves to produce a feedback to the active element which ensures the actuation of the oscillator and the ignition of the plasma. This feedback is preferably implemented inductively by running a feedback line 19, which is connected to the hollow body 6 as well and which can be constructed cost-effectively as a micro-strip line, along a section of the coil 7 that is arranged outside the hollow body 6. The feedback line 19 is thus inductively coupled to the coil 7 and transmits the oscillation absorbed by the coil 7 back to the active element.

The invention claimed is:

1. A plasma source with an oscillator, said oscillator having an active element and a resonator connected to the active element, wherein the resonator has a hollow body, a gas inlet, a gas outlet arranged at a distal end of the hollow body about a longitudinal axis of the hollow body, and a coil arranged within the hollow body along the longitudinal axis of the hollow body, said coil having an effective length of one quarter of a wavelength at a resonant frequency of the resonator, wherein a distal end of the coil is arranged relative to the gas outlet such that a plasma section can form between the distal end of the coil serving as a first plasma electrode and the gas outlet of the hollow body serving as a second plasma electrode, characterized in that the coil is lead out of the interior of the hollow body at a proximal end of the hollow body through an electrically contact-free feed-through, and a proximal end of the coil contacts the hollow body at its external side, wherein, at a first contact region located between the proximal end of the coil and the feed-through, the coil is coupled to a first gate of the active element, and at a second contact region located between the proximal end of the coil and the feed-through, the coil is coupled to a second gate of the active element.

2. The plasma source of claim 1, wherein the first contact region is coupled to the first gate of the active element through a first capacitor.

3. The plasma source of claim 1, wherein the coil is inductively coupled to the second gate of the active element at the second contact region.

4. The plasma source of claim 3, having a feedback line arranged in the second contact region along and spaced apart from the coil and being designed such as to couple the coil inductively to the second gate of the active element.

5. The plasma source of claim 4, wherein the feedback line contacts the hollow body at its external side.

6. The plasma source of claim 4, wherein the feedback line is coupled to the second gate of the active element through a second capacitor.

7. The plasma source of claim 1, wherein the coil in the section between the feed-through and the proximal end of the coil is constructed as a micro-strip line.

8. The plasma source of claim 1, wherein the first gate of the active element is connected to a first matching network and the second gate of the active element is connected to a second matching network.

9. The plasma source of claim 8, wherein the first matching network has a first variable capacitor and the second matching network has a second variable capacitor.

10. The plasma source of claim 1, having a first DC power feed connected to the first gate of the active element and a second DC power feed connected to the second gate of the active element.

11. The plasma source of claim 1, wherein the hollow body of the resonator has a cylindrical shape.

12. The plasma source of claim 1, having a gas feed connected to the gas inlet, said gas feed being designed such as to pump a plasma gas through the gas inlet into the hollow body of the resonator.

13. Utilization of a plasma source of claim 1 for activating, cleaning, sterilizing and coating surfaces, for etching, and for purifying water and exhaust gases.

* * * * *